United States Patent [19]

Yang

[11] Patent Number: 4,616,823

[45] Date of Patent: Oct. 14, 1986

[54] EXERCISE BICYCLE WITH INCLINED SEATS FOR TWO PEOPLE

[76] Inventor: Tai-Her Yang, 5-1, Tai-Pin Street, Si-Hu Town, Dzan-Hwa, Taiwan

[21] Appl. No.: 640,775

[22] Filed: Aug. 14, 1984

[51] Int. Cl.[4] ..... A63B 23/04

[52] U.S. Cl. ..... 272/73; 272/134

[58] Field of Search ..... 272/73, DIG. 5, 134, 272/DIG. 6; 74/572; 248/420; 297/346

[56] References Cited

U.S. PATENT DOCUMENTS

| | | | |
|---|---|---|---|
| 1,909,002 | 5/1933 | Oehlberg | 272/73 |
| 2,474,370 | 6/1949 | Russell | 74/572 |
| 3,727,913 | 4/1973 | Glaser et al. | 272/73 |
| 4,298,893 | 11/1981 | Holmes | 272/73 |

*Primary Examiner*—Leo P. Picard

*Attorney, Agent, or Firm*—Cushman, Darby and Cushman

[57] ABSTRACT

The present invention helps make the use of indoor sporting equipment fun and thereby promotes the use of such equipment and makes people more interested in exercising. Briefly, the present invention is an improved design for an exercise bicycle which has more than one function. The present invention promotes exercise and training, improves both active and passive coordination of leg muscle reaction, and aids in establishing relationships between people. The present invention includes a stationary frame attached to which is a first seat which is movable between at least an upright position and a reclined position. A pedal assembly is rotatably journalled to the frame, and a frictional fly wheel assembly is coupled to the pedal assembly and offers resistance to the rotation of the pedal assembly. An electro-mechanical assembly (e.g., a dynamotor, a generator or the like) is coupled to the pedal assembly to rotate the pedal assembly or to generate electrical power in response to manual rotation of the pedal assembly at the selection of a user. A manual operational reaction training device is provided to help the user train himself or herself to react. An auxiliary seat is provided on the same frame facing and opposing the first seat to permit another person to participate in the exercise.

4 Claims, 31 Drawing Figures

Fig. 13
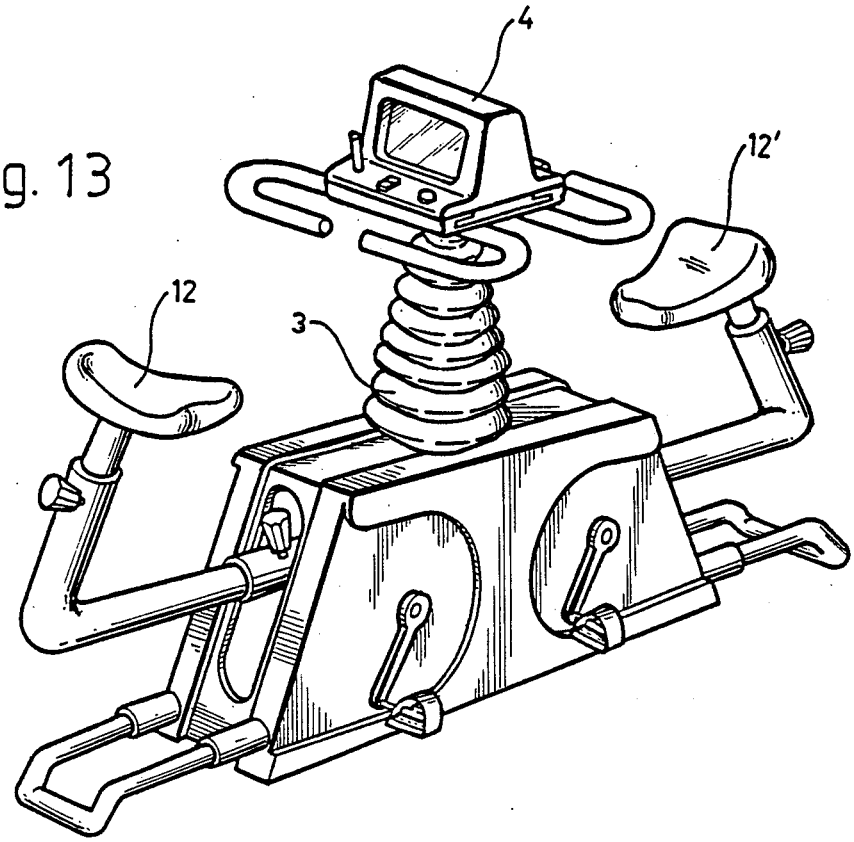
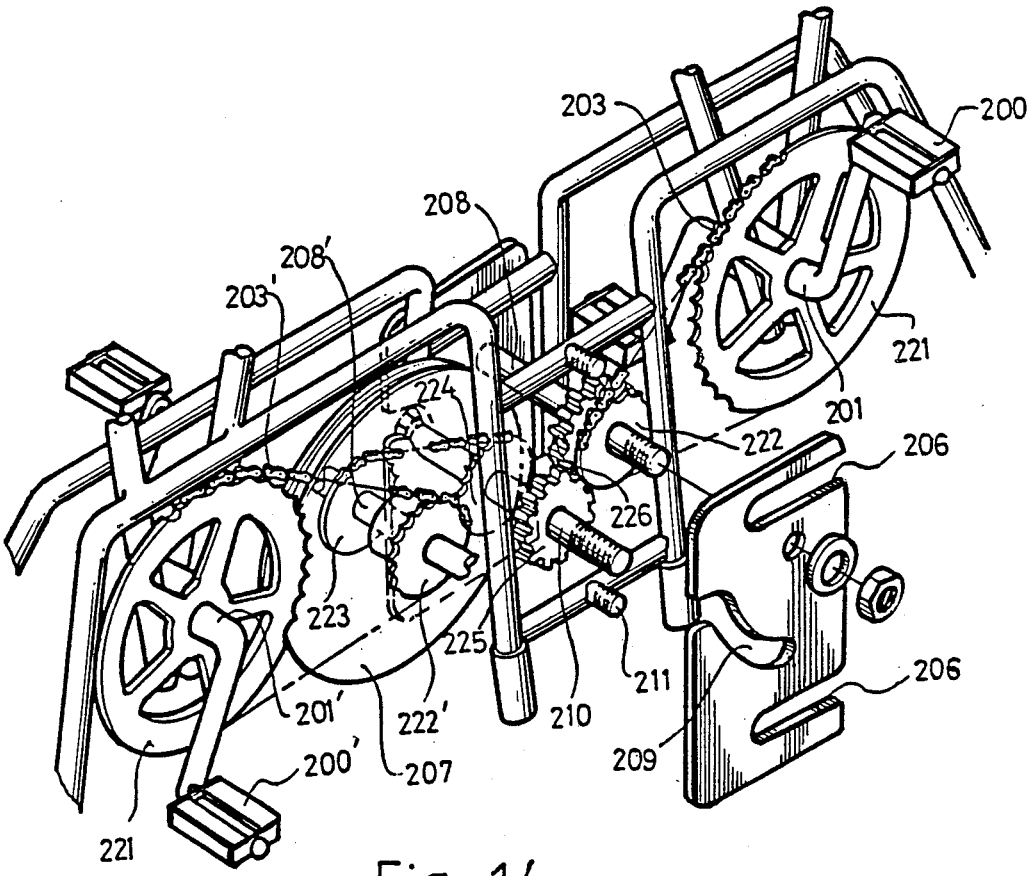
Fig. 14

EXERCISE BICYCLE WITH INCLINED SEATS FOR TWO PEOPLE

FIELD OF THE INVENTION

The present invention is related to devices which aid a person in physically exercising himself or herself, and more particularly, to stationary exercise bicycles which simulate two-wheeled human-driven vehicles.

BACKGROUND OF THE INVENTION

Exercise bicycles which help a person to exercise by simulating a two-wheeled vehicle are, in general, known. Such known exercise bicycles generally include a frame, a seat connected to the frame for supporting a human rider, pedals rotatably journalled to the frame for being operated by the feet of the rider, and an adjustable friction-producing device (e.g., a damping wheel or the like) coupled to the pedals for offering resistance to the efforts of the rider to rotate the pedals. The seat of such known exercise bicycles is generally fixed to the end of a supporting rod which is inserted into a vertically-oriented, hollow cylindrical tube (typically part of the frame) which has an inside diameter which is larger than the outside diameter of the supporting rod. The supporting rod is axially slided into and out of the tube to adjust the height of the seat with respect to the pedals. A clamp or similar device is used to fix the position of the supporting rod with respect to the tube once the seat is moved to a desired position.

Conventional exercise bicycles provide an inexpensive way to obtain the cardiovascular exercise that medical doctors strongly advocate as being so important to long life and good health. Unfortunately, known exercise bicycles are generally uncomfortable to sit on for extended periods of time, limiting the amount of time people wish to spend exercising to only short periods. The use of known exercise bicycles is generally a lonely and solitary experience, for it is difficult to talk with another person while exercising unless that other person walks up and stands in front of the exercise bicycle. It is therefore often rather boring to exercise using a known exercise bicycle.

Because of the importance of exercise to good health and long life, any way to make exercise more interesting and fun and thereby encourage people to exercise more often and for longer periods of time would be a welcomed innovation.

SUMMARY OF THE INVENTION

Thus, the present invention relates to a reclining and/or sitting, active or passive gymnastic device especially useful for muscle reaction, active pedalling, passive rehabilitation, and reaction training. In accordance with the present invention, a user can sit upright, or may instead recline. Moreover, an auxiliary seat is provided to permit an additional person to participate in exercise. The present invention helps make exercising of limbs and training of reactions and motor skills fun and interesting. By permitting an additional person to participate in the exercise, human interaction is promoted, and the body and the brain of the user are exercised simultaneously.

BRIEF DESCRIPTION OF THE DRAWINGS

These and other features and advantages of the present invention may be better understood by referring to the following detailed description of preferred embodiments in conjunction with the drawings, of which:

FIG. 13 is an elevated perspective view of a third presently preferred exemplary embodiment of an exercise bicycle in accordance with the present invention, this third embodiment including two seats, two pedal assemblies and a reaction training device usable by two users simultaneously;

FIG. 14-1 is a side elevated view of the drive mechanism shown in FIG. 14;

FIG. 14-2 is a top view in plan of the drive mechanism shown in FIG. 14;

FIGS. 14-3 and 14-4 are side views of the positioning of the transfer plate shown in FIG. 14 for use of the embodiment shown in FIG. 13 by two users simultaneously;

FIG. 15-1 is a side elevated view of the drive mechanism shown in FIG. 15;

FIG. 15-2 is a top view in plan of the drive mechanism shown in FIG. 15;

FIG. 16-1 is an elevated side view of the drive mechanism shown in FIG. 16;

FIG. 16-2 is an top view in plane of the drive mechanism shown in FIG. 16;

FIG. 17-1 is an end view in cross-section of the flywheel shown in FIG. 17;

FIG. 17-2 is an elevated view in perspective and cross-section of the flywheel shown in FIG. 17;

FIG. 18-1 is an end view of the flywheel shown in FIG. 18;

FIG. 19-1 is an elevated side view in cross-section and perspective of the flywheel shown in FIG. 19.

DETAILED DESCRIPTION OF PREFERRED EMBODIMENTS

Figure 1:
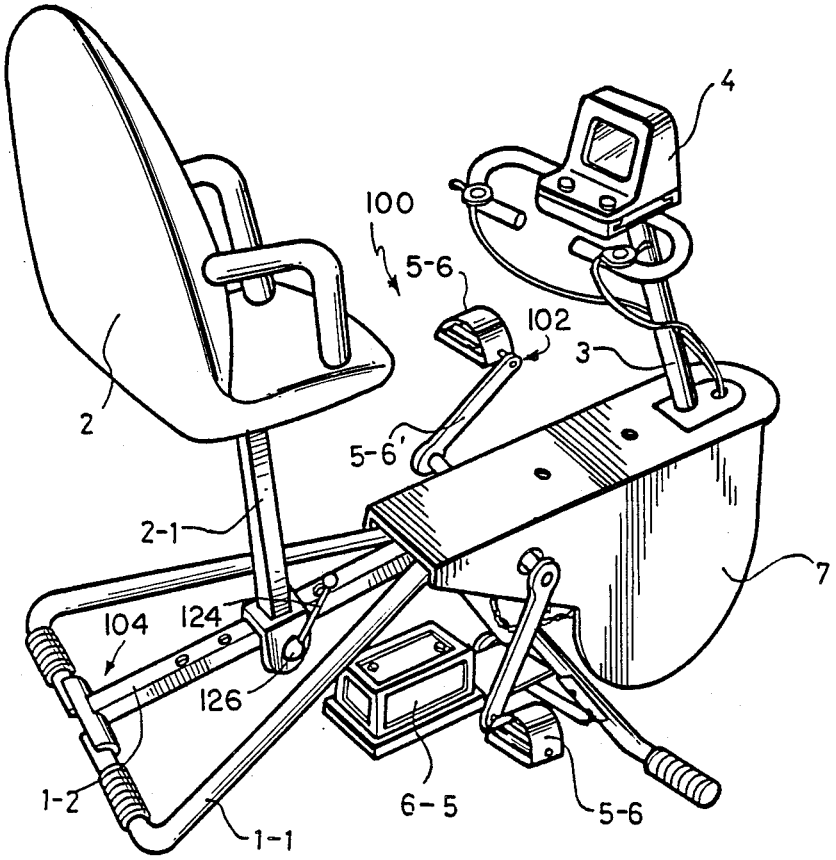
FIG. 1 is an elevated perspective view of a first presently-preferred exemplary embodiment of an exercise bicycle in accordance with the present invention.
Figure 2:
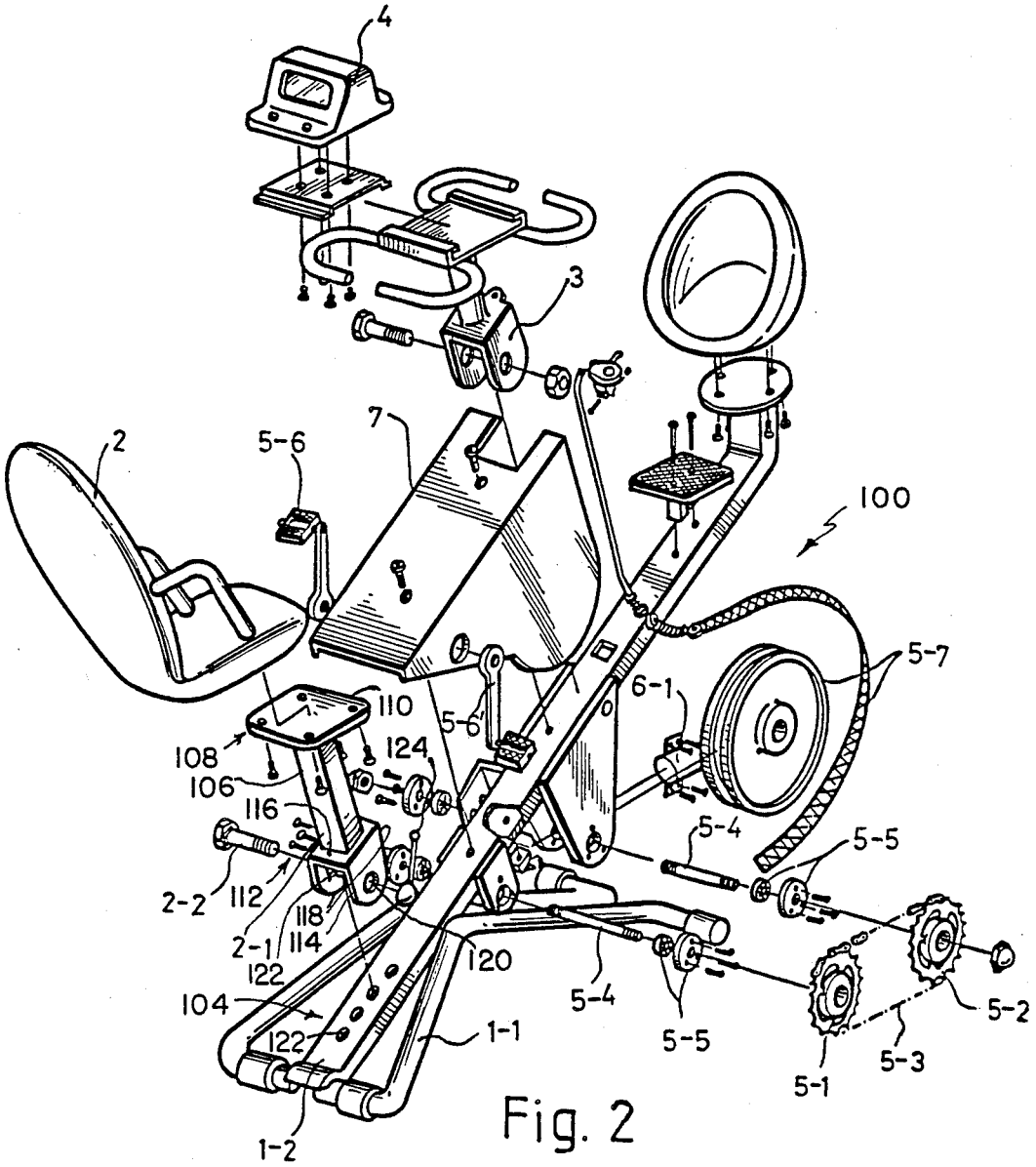
FIG. 2 is an elevated exploded view in perspective of the embodiment shown in FIG. 1.

FIGS. 1 and 2 are respectively an elevated perspective view and an exploded elevated perspective view of a first presently preferred exemplary embodiment of an exercise bicycle in accordance with the present invention. The embodiment shown in FIGS. 1 and 2 includes a bicycle frame main body 100 which rests on and is stationary with respect to the ground. The bicycle frame main body 100 includes a main bar 1-1 and a subsidiary bar 1-2. The subsidiary bar 1-2 is fixed to and joined (coupled) to the main bar 1-1, and supports the main bar 1-1 and a seat 2. A handlebar assembly 3 is journalled to main bar 1-1 by screws or other known fastening devices. A manual operational reaction training device 4 is fixed to handlebar assembly 3.

A pedal driving element 102 is pivotably (rotatably) journalled to subsidiary frame 1-2 via a drive axle 5-4 and a bearing (suitably a ball bearing) assembly 5-5. The pedal driving element 102 includes a drive chain wheel 5-1, a driven chain wheel 5-2, a chain 5-3 (which rotatably couples wheels 5-1 and 5-2 together), pedals 5-6 and a crank set 5-6' (the crank set being levers or other members to which pedals 5-6 are journalled and which are coupled to the drive axle 5-4). Driven chain wheel 5-2 is coupled to a damping flywheel 5-7 (a damping belt 5-8 or a damping friction gear could be used instead) which produces mechanical damping (and thus offers friction to the rotation of pedals 5-6 by an operator).

An electrical storage device 6-5 accumulates electrical power generated by an electromechanical device (e.g., a dynamotor or the like, not shown in FIGS. 1 and 2) which is coupled to pedal driving element 102. The electromechanical device may convert the mechanical power produced by an operator pedalling the pedal driving element 102 into electrical power and apply this electrical power to electrical storage device for storage therein. Electromechanical device 6-1 is coupled to the pedal driving element 102 via the damping flywheel 5-7 in the preferred embodiment. Electromechanical device 6-1 can supply electrical power to operate the manual reaction training device 4, or alternatively, can be used to generate mechanical power (by converting electrical power stored in storage device 6-5 into mechanical energy) to drive the pedal driving element 102 and thereby permit an operator to exercise passively.

A decorative plate 7 is fixed to main bar 1-1 (e.g., by a screw or other fastener) in a position which causes it to cover the pedal driving components (e.g., driving wheels 5-1 and 5-2, damping flywheel 5-7. etc).

The manner in which seat 2 is mounted to frame body 100 will now be described. One end of a seat supporting rod 2-1 is fixed by a fixing pin 2-2 to an end 104 of subsidiary bar 1-2. The position of seat 2 can be changed to permit the operator to recline or sit more comfortably and thereby allow the operator to exercise his brain as well as his body to stimulate his reaction time and strengthen his body. And is clearly shown in FIGS. 1 and 2, seat supporting rod 2-1 includes an elongated rectangular shaft portion 106 terminating at a first end 108 in a square mounting plate 110 (fixed approximately perpendicularly to the shaft portion 106) and terminating at its other end 112 in a mounting flange 114. Seat 2 is mounted to plate 110 with fastening device (e.g., screws).

Mounting flange 114 is U-shaped, the center portion 116 of the U being fixed to end 112 of shaft portion 106 with the two "legs" 118 of the U extending axially away from the shaft portion. Each "leg" 118 of mounting flange 114 has a circular hole 120 cut therethrough, the two holes positioned relative to one another such that they are in registry with one another. A cylindrical pin extends axially from shaft portion 106 within the U of mounting flange 114, this pin having a length which is less than the length of legs 118 of the flange.

A plurality of circular holes 122 are defined in the end 104 of subsidiary bar 1-2 facing upward toward seat 2. These holes 122 are approximately evenly spaced in the preferred embodiment, and have diameters which are slightly larger than the outside diameter of pin 122. To attach supporting rod 2-1 to frame body 100, one of circular holes is selected, and pin 118 is inserted into the selected hole. The spacing between legs 118 of flange 114 is larger than the width of subsidiary bar 1-2 such that pin 118 can be inserted into the selected one of holes 122 and the legs 118 of the flange project onto respective sides of the subisidiary bar. Pin 2-2 is then inserted into one of holes 120, and pushed to extend under subsidiary bar 1-2 into the other hole 120. A lever 124 terminates in a hemispherical portion 126 which is connected to pin 2-2. Lever 124 is movable between a forward (locked) position and a rear (adjust) position. When lever 124 is in the forward position, the two legs 118 of flange 114 are pulled together (and pin 118 and portion 116 of the flange are pulled firmly toward subsidiary bar 1-2) to prevent the seat supporting rod 2-1 from moving relative to subsidiary bar 1-2. If lever 124 is moved to the rear position, the tension applied to the two legs 118 of flange 114 by pin 2-1 is released and the seat supporting shaft can be lifted (to disengage pin 118 from the one of circular holes 118 into which it was formerly inserted) and slided forward or backward on subsidiary bar 1-2. A new one of circular holes 122 may be selected, pin 118 may be engaged with that new hole, and lever 124 may then be moved to its forward position to lock seat supporting shaft 2-1 into its new position.

Because subsidiary bar 1-2 as supported by main bar 1-1 is inclined, movement of seat supporting shaft 2-1 with respect to subsidiary bar 1-2 changes both the height of the seat 2 (i.e., the distance from the seat to the ground) and the distance from the seat to pedal driving element 102. Moreover, the inclination of subsidiary bar 1-2 causes the back 124 of seat 2 to be inclined backward from vertical, allowing the person sitting in the seat to lean backwards as he exercises. The angle of inclination of the back 124 of seat 2 is predetermined and is set by the angle of inclination of subsidiary bar 1-2 and by the angle at which plate 110 meets shaft portion 106.

Figure 3:
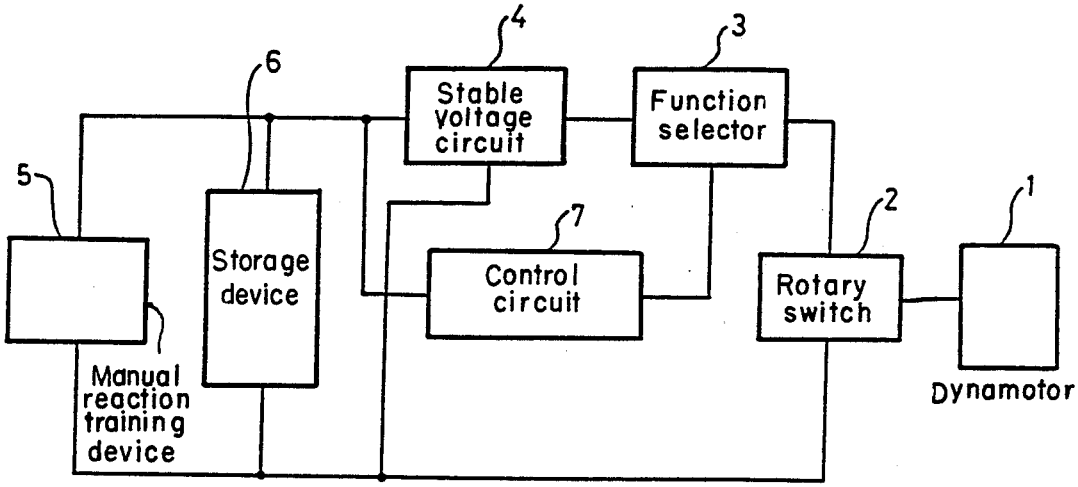
FIG. 3 is a block schematic diagram of the electrical circuit elements of the embodiment shown in FIG. 1.

FIG. 3 is a schematic block diagram of the circuit elements of the embodiment shown in FIGS. 1 and 2. Such circuit elements include an electromechanical device (e.g., a dynamotor set or the like) 1, a rotary selector switch 2 (rotatable in a clockwise and/or counterclockwise direction), a function selector 3, a stable voltage circuit 4, a manual operational reaction training device 5, an electrical storage device 6, and a control circuit 7. Function selector 3 selects the function of electromechanical device 1 as alternately a motor and a generator. When electromechanical device 1 is used as a dynamotor, storage device 6 supplies the electrical power to power the electromechanical device while control circuit 7 controls the dynamics of the output of the electromechanical device. Electromechanical device 1 may be a bidirectional device (i.e., its output shaft may alternately rotate clockwise of counterclockwise), and the direction of rotation of the shaft of electromechanical device 1 may be controlled by the position (either clockwise or counterclockwise) of rotary switch 2. Electrical storage device 6 supplies electrical power to manual operational reaction training device 5, and electrical power produced by the electromechanical device 1 (after being regulated by stable voltage circuit 4) can supplement or be used instead of the power stored in the storage device to power training device 5.

Figure 4:
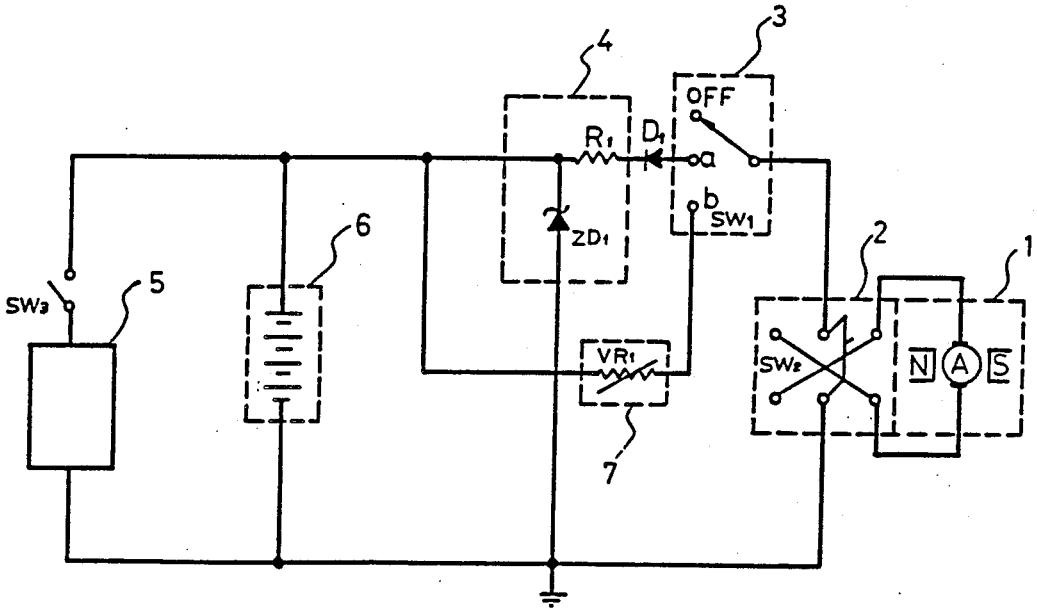
FIG. 4 is a more detailed schematic diagram of the circuit elements shown in FIG. 3.
Figure 5:
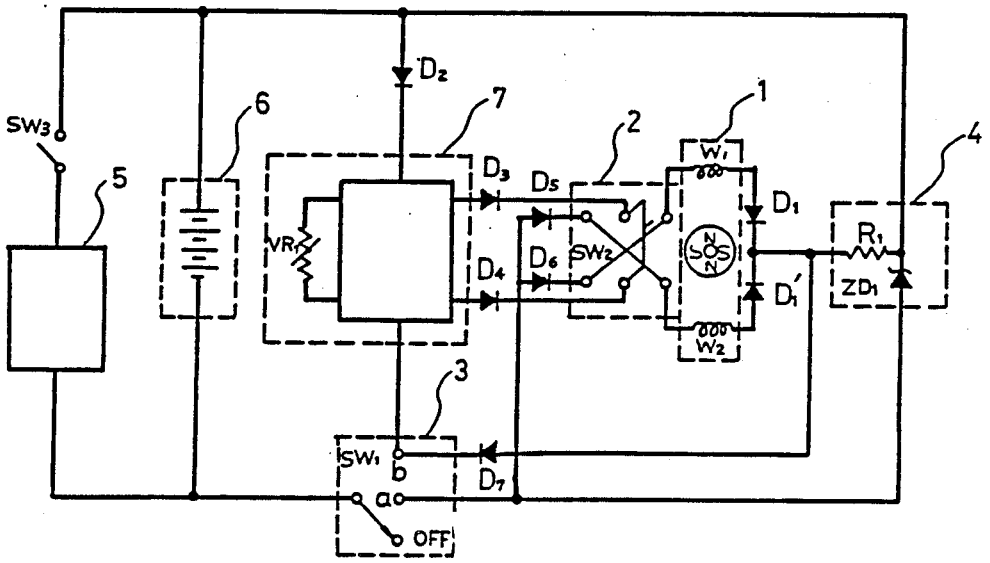
FIG. 5 is a detailed schematic diagram of a further embodiment of the circuit elements shown in FIG. 3.
Figure 6:
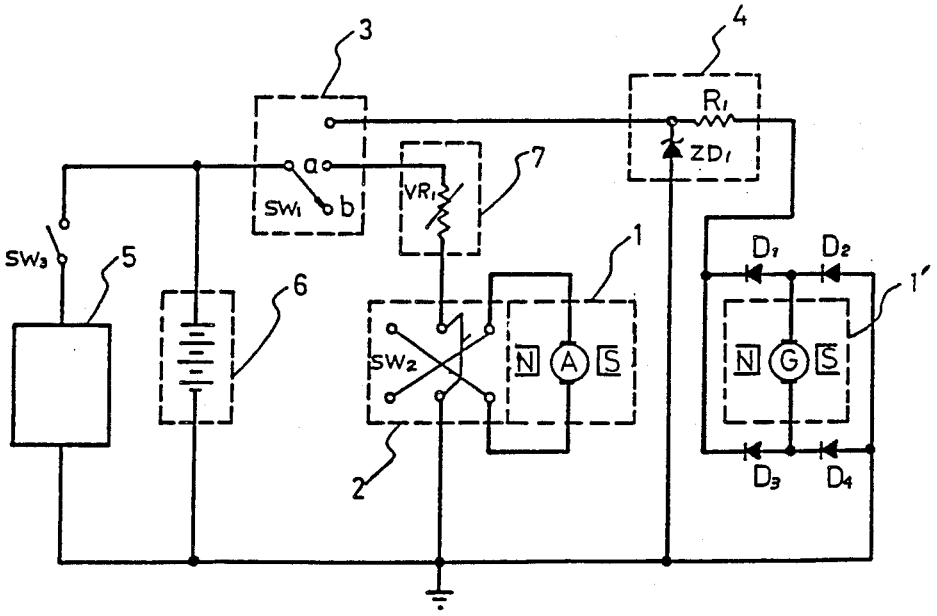
FIG. 6 is a detailed schematic diagram of a further embodiment of the circuit elements shown in FIG. 3.
Figure 7:
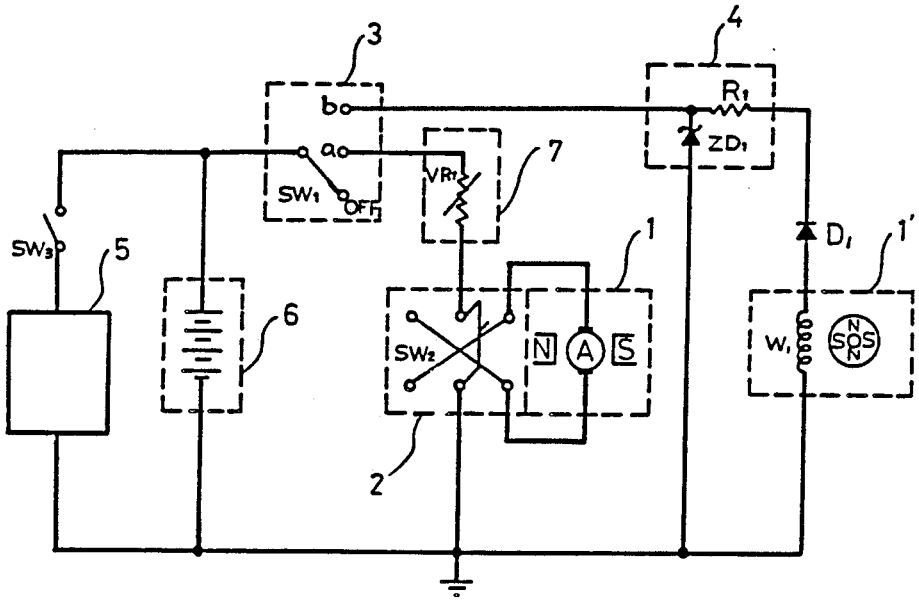
FIG. 7 is a detailed schematic diagram of a still further embodiment of the circuit elements shown in FIG. 3.

FIG. 4 is a schematic diagram of one embodiment of the electrical circuitry shown in FIG. 3. In the embodiment shown in FIG. 4, electromechanical device 1 comprises a dynamotor set, rotary switch 2 comprises a single-pole double throw switch, function selector 3 is a selective switch, and control circuit 7 comprises a variable resistor. When switch 3 is moved to a position a, dynamotor 1 acts as a generator to convert mechanical power into electrical power (this electrical power is regulated by circuit 4 and applied to storage device 6 and training device 5). When switch 3 is moved to position b, the dynamotor 1 functions as a motor to produce mechanical energy from electrical energy supplied to it by storage device 6. Dynamotor 1 rotates pedal driving element 102 to permit the person exercising to simply rest his or her feet on the pedals 5-6 and passively exercise. The position of rotary switch 2 controls the polarity of the voltage applied to dynamotor 1, and thus selects whether the shaft of the dynamotor rotates clockwise or counterclockwise. Variable resistor 7 is used to adjust the voltage applied to dynamotor 1 (and thus the rotational speed of pedal driving element 5-6) to permit persons of different ages and different physical conditions to tailor exercise parameters to their own needs. FIGS. 5–7 are schematic diagrams of other exemplary embodiments of the circuitry shown in the block diagram of FIG. 3. The embodiment shown in FIG. 5 includes a permanent magnet two-phase step driving dynamotor set 1, and a DC/AC converter. FIG. 6 shows an embodiment including an armature independent dynamo generator set 1' connected to a bridge rectifier. FIG. 7 includes a permanent magnet type multi-phase independent dynamo 1 and an independent generator set 1'. The details of the structure and operation of these various embodiments of the circuit elements shown in FIG. 3 may be readily ascertained from the FIGURES by those skilled in the art.

Figure 8:
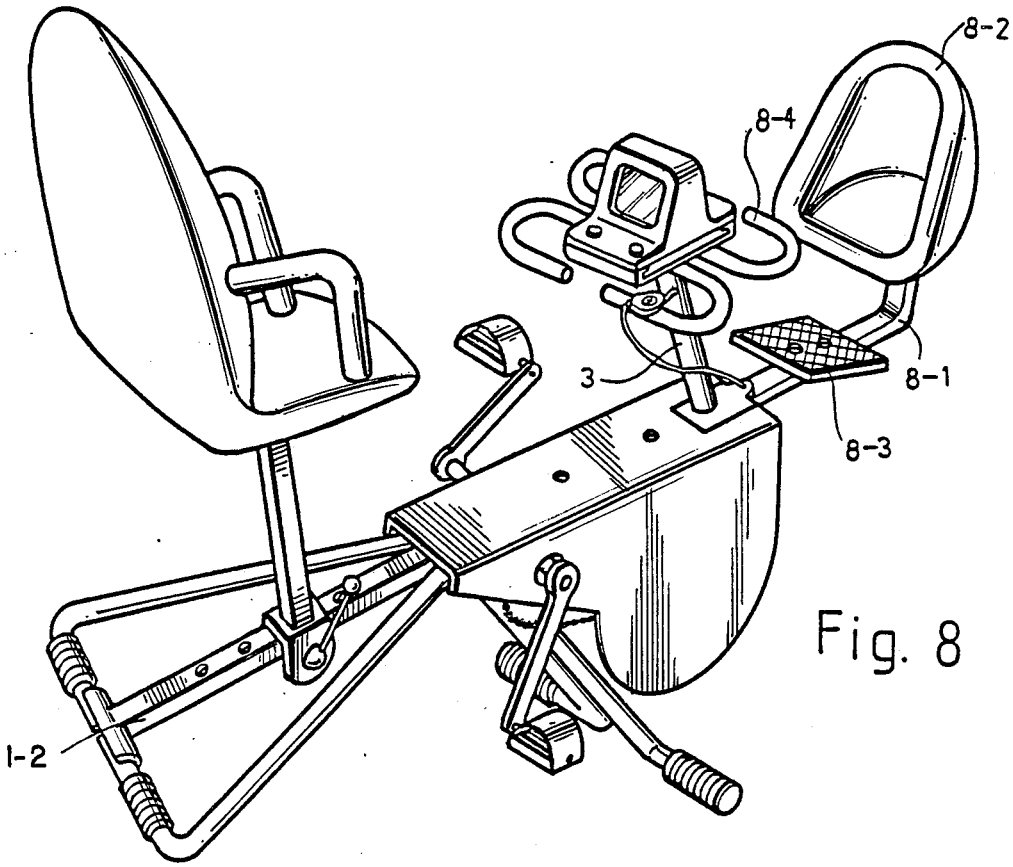
FIG. 8 is an elevated perspective view of a second presently preferred exemplary embodiment of an exercise bicycle in accordance with the present invention, this second embodiment including an auxiliary seat for supporting a second user.

FIG. 8 is an elevated perspective view of a further embodiment of an exercise bicycle in accordance with the present invention, this further embodiment including an auxiliary seat 8-2 which permits a second person to participate in the exercise activity. In the embodiment shown in FIG. 8, subsidiary bar 1-2 is lengthened (as compared to the length of this bar in the embodiment shown in FIG. 1) and an auxiliary seat 8-2 is fixed to the extended end of the bar. A shape-supporting rod 8-1 extends from subsidiary bar 1-2. Auxiliary seat 8-2 is fixedly mounted to rod 8-1. A platform 8-3 is mounted to rod 8-1 to support the feet of a person seated in the auxiliary seat 8-2, and an extra set of handlebars is provided for the hands of the person seated in the auxiliary seat. Auxiliary seat 8-2 can adjust and slide in position along subsidiary bar 1-2 if desired, and may be provided with an adjusting means to selectively lock it in a desired position.

Figure 9:
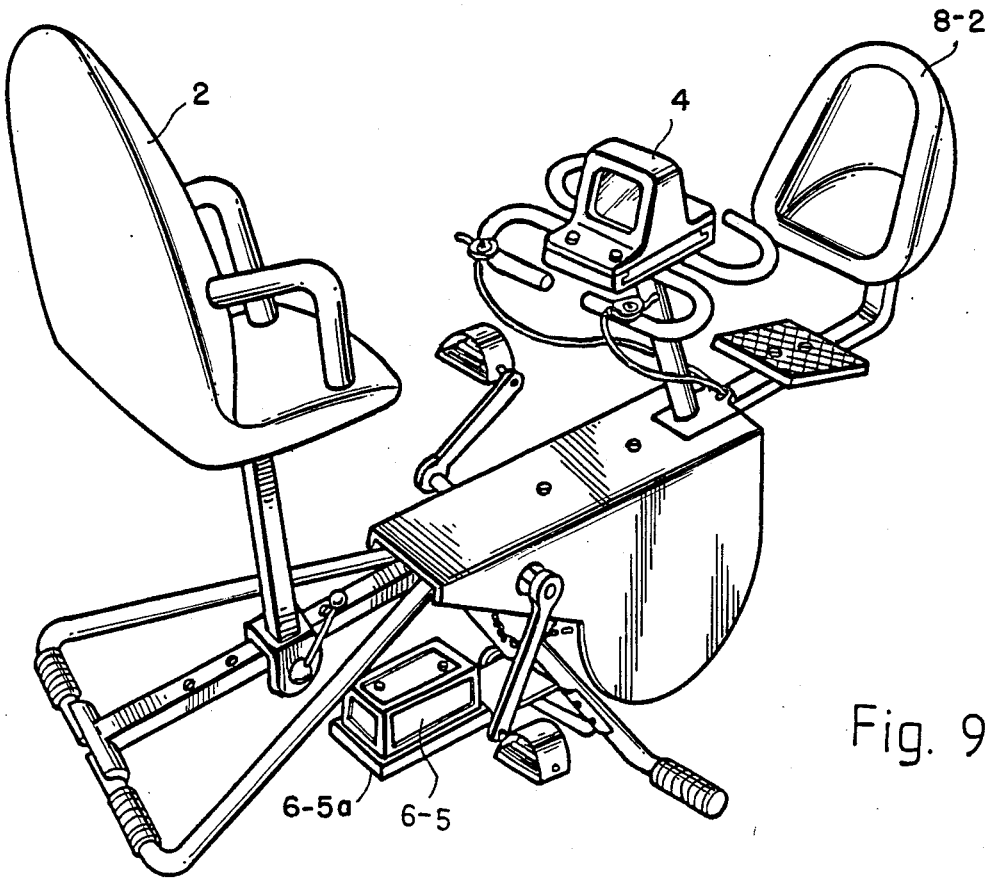
FIG. 9 is an elevated perspective view of the embodiment shown in FIG. 8 modified to include an electrical storage device.

FIG. 9 shows a further embodiment of an exercise bicycle which is provided with an electrical storage device 6-5 mounted on a platform 6-5*a*. Storage device 6-5 provides electrical power to power the manual operational reaction training device 4. Reaction training device 4 can be used and operated by both the person seated in the seat 2 and the person seated in the auxiliary seat 8-2.

Figure 10:
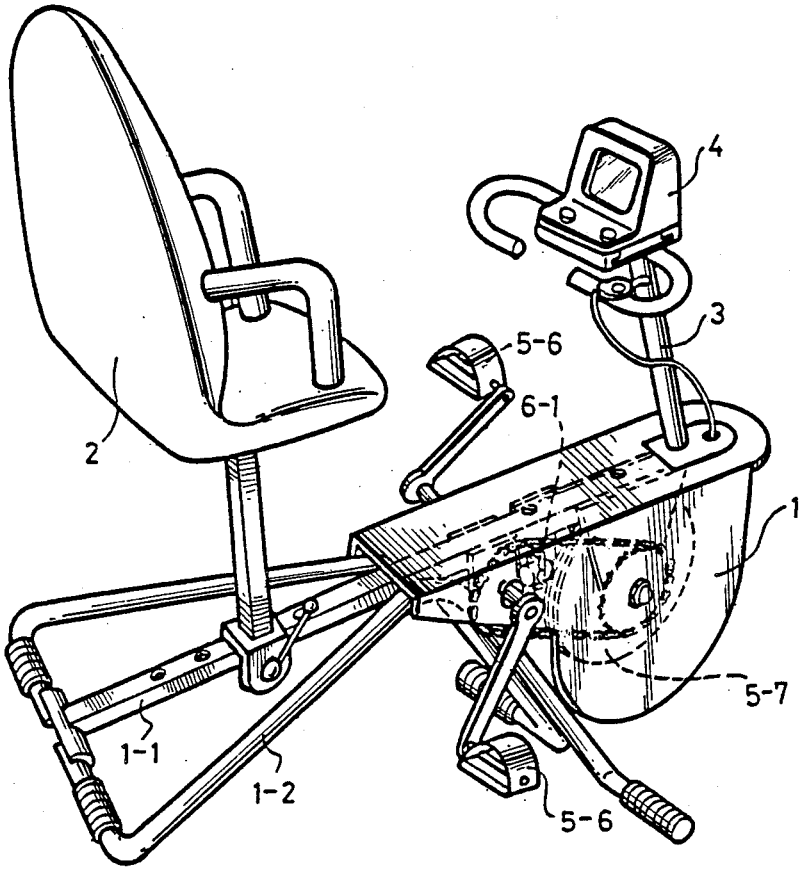
FIG. 10 is an elevated perspective view of the embodiment shown in FIG. 1 shown with an outer case thereof partially cut away to expose the drive mechanism of the embodiment.

FIG. 10 shows an embodiment similar to the one shown in FIG. 1, the difference being that the embodiment shown in FIG. 10 does not include an electrical storage device.

Figure 11:
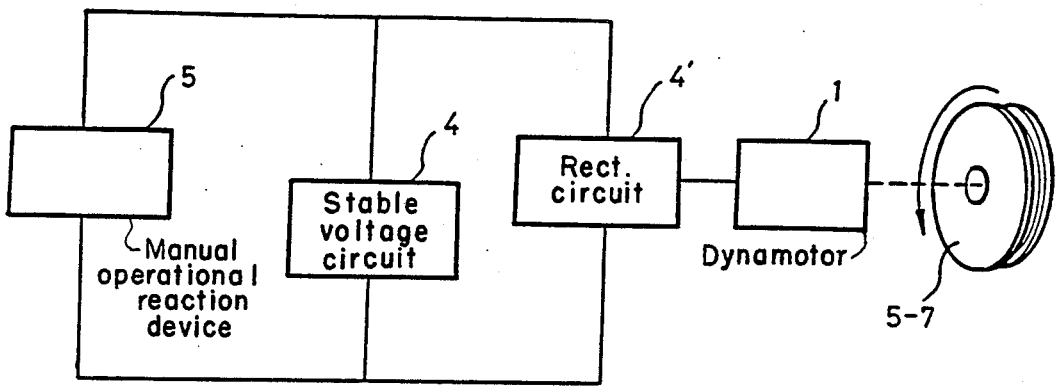
FIG. 11 is a schematic block diagram of an further embodiment of the electrical circuit elements and the coupling of these elements to a flywheel of the embodiment shown in FIG. 1.
Figure 12:
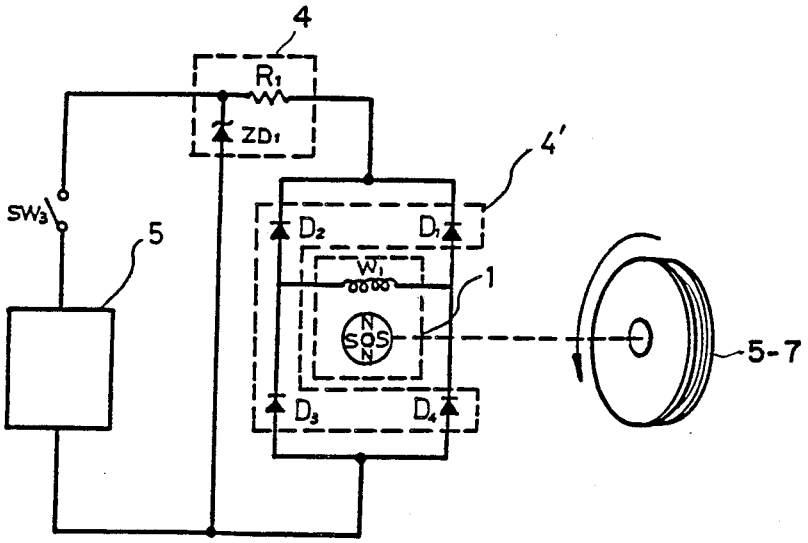
FIG. 12 is a more detailed schematic diagram of the electrical circuit elements shown in FIG. 11.
Figures 1, 14:
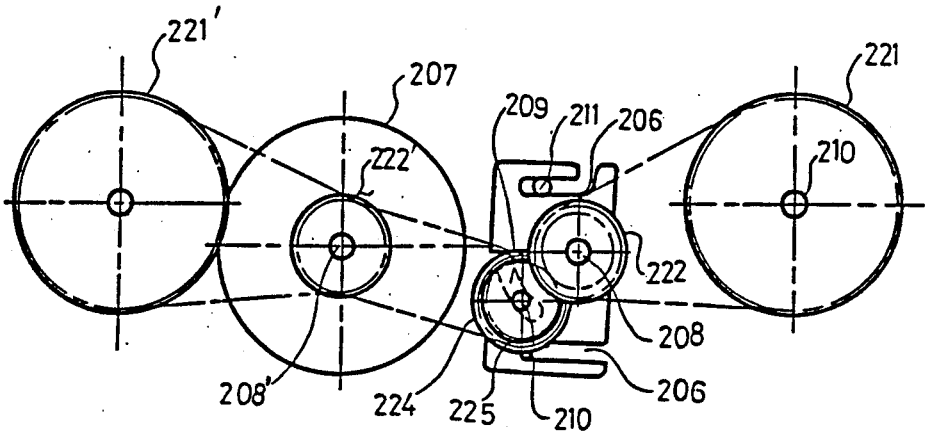
FIG. 14 is an elevated perspective view of the drive mechanism of the embodiment shown in FIG. 13.
Figures 2, 14:
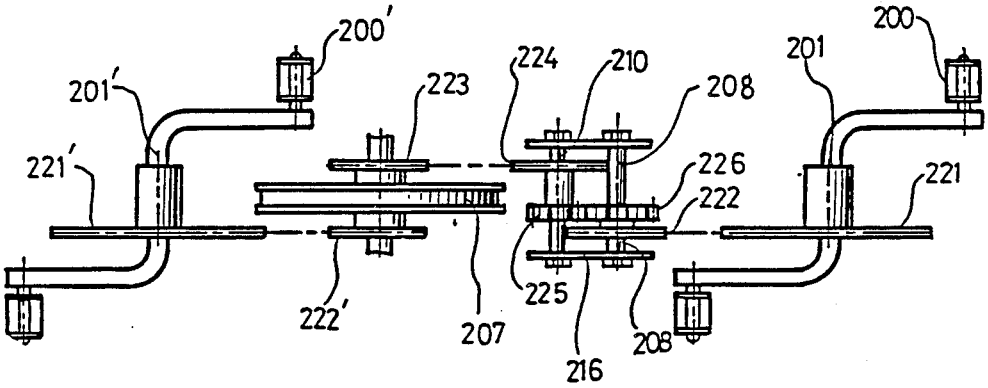
Figures 3, 14:
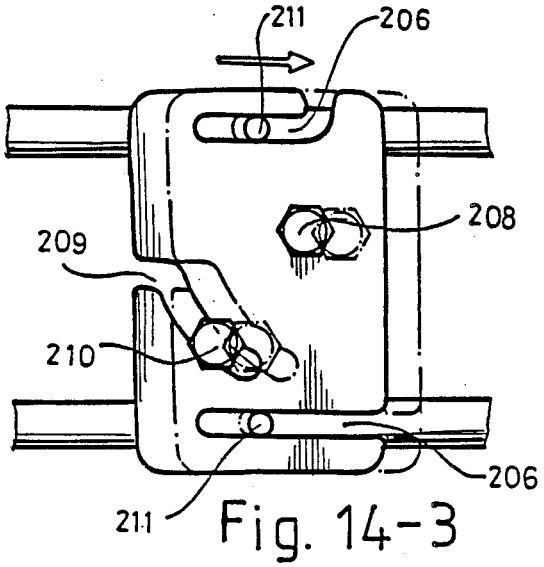
Figures 4, 14:
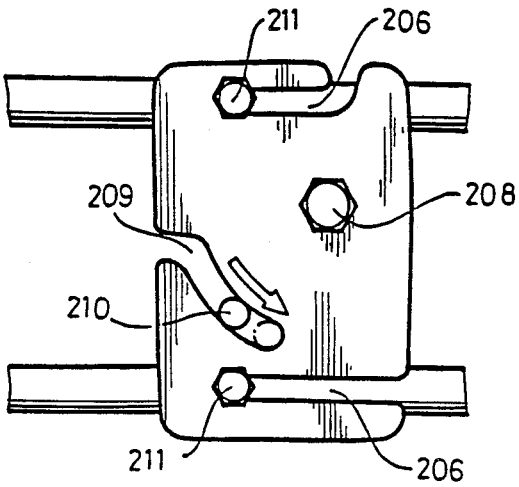

FIG. 11 is a block schematic diagram of an exemplary self-generating and driving reaction training device including a double functional flywheel 5-7 for stabilization and damping, a dynamotor set 1, a stable voltage circuit, a rectifying circuit 4', and a manual operational reaction and training device 5. Mechanical energy (the rotation of flywheel 5-7) is applied to dynamotor 1, which converts the mechanical energy to electrical energy. This electrical energy is applied to rectifier circuit 4' for rectification, and is regulated by stable voltage circuit 4 for application to manual operational reaction training device 5. FIG. 12 is a more detailed schematic diagram of the exemplary circuit shown in FIG. 11. Flywheel 5-7 is used for stabilization and damping. When the person exercising pedals the pedal driving element 102, the person must overcome the resistance to pedalling offered by flywheel 5-7, and thus is better exercised. Moreover, flywheel 5-7 helps to stabilize the voltage produced by dynamotor 1.

Figure 15:
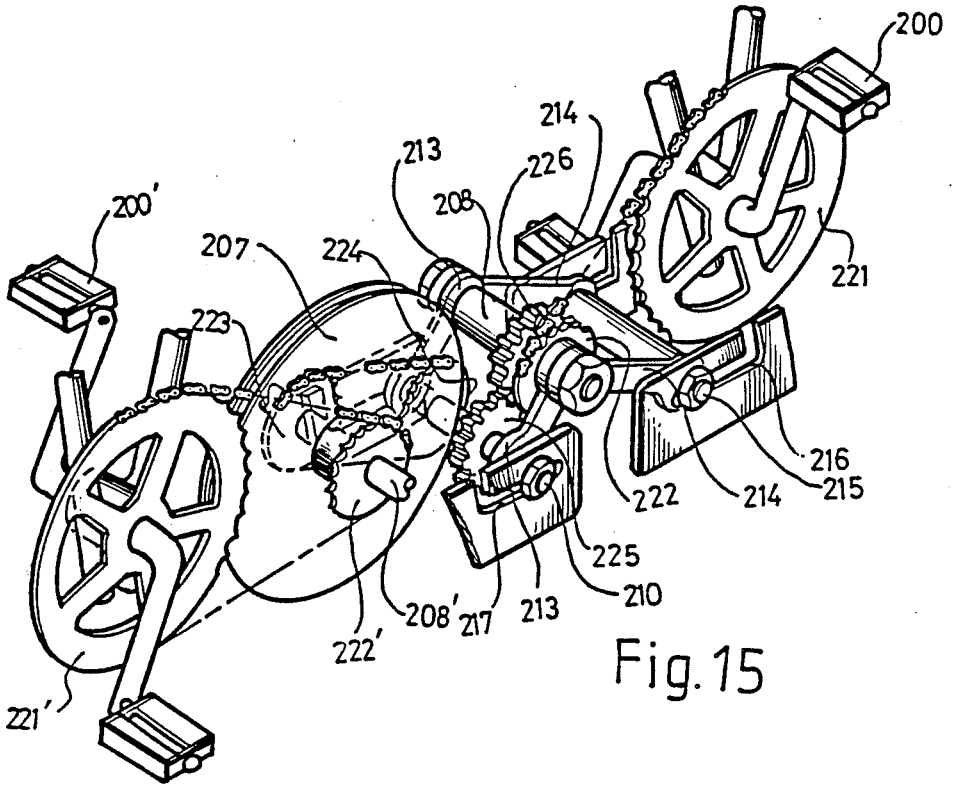
FIG. 15 is an elevated perspective view of a further exemplary drive mechanism usable with the embodiment shown in FIG. 13.
Figures 1, 15:
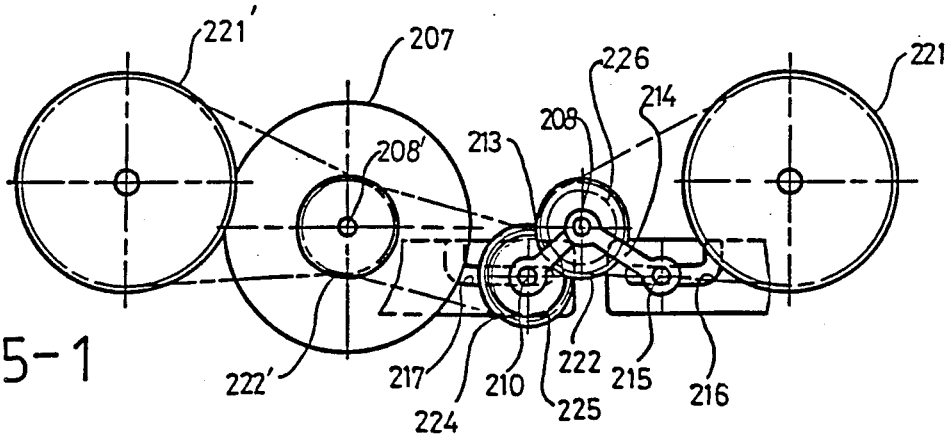
Figures 2, 15:
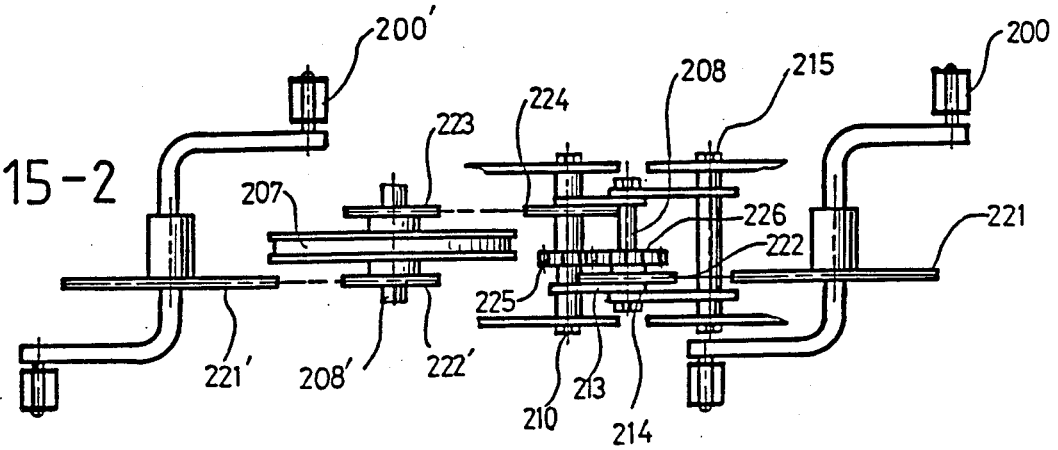
Figure 16:
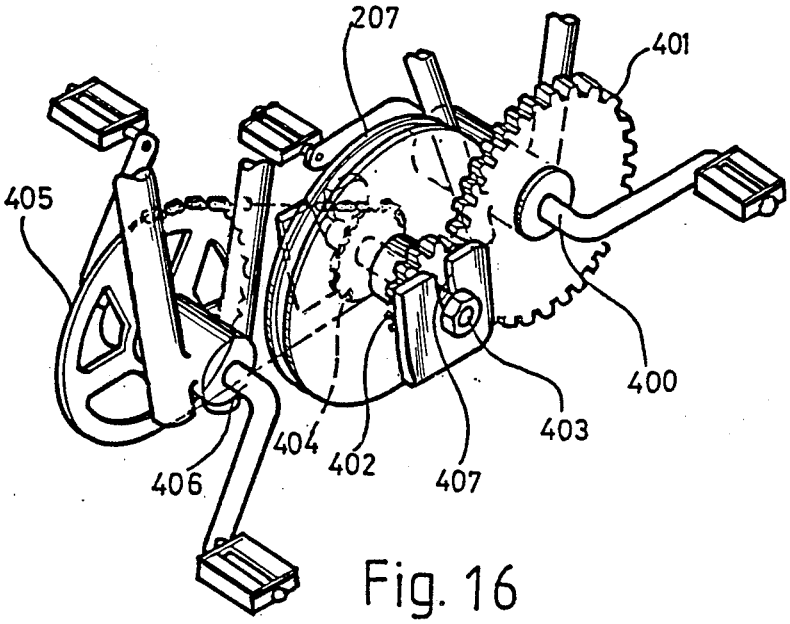
FIG. 16 is an elevated perspective view of a still further exemplary drive mechanism usable with the embodiment shown in FIG. 13.
Figures 1, 16:
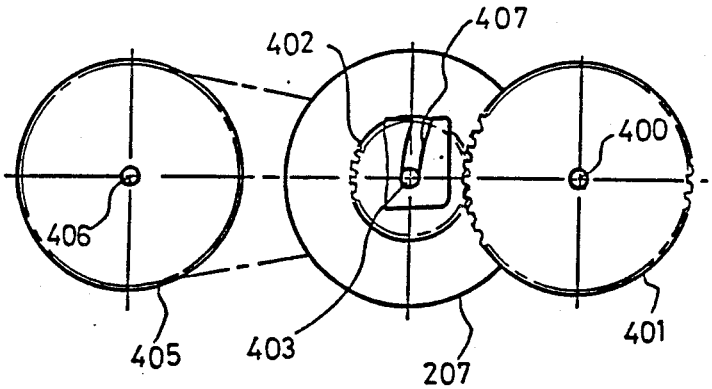
Figures 2, 16:
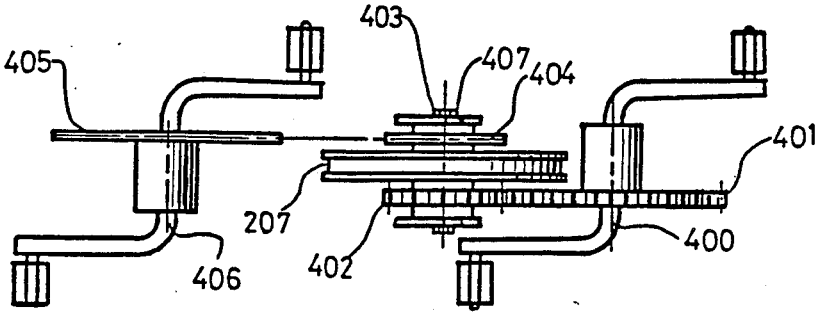
Figure 17:
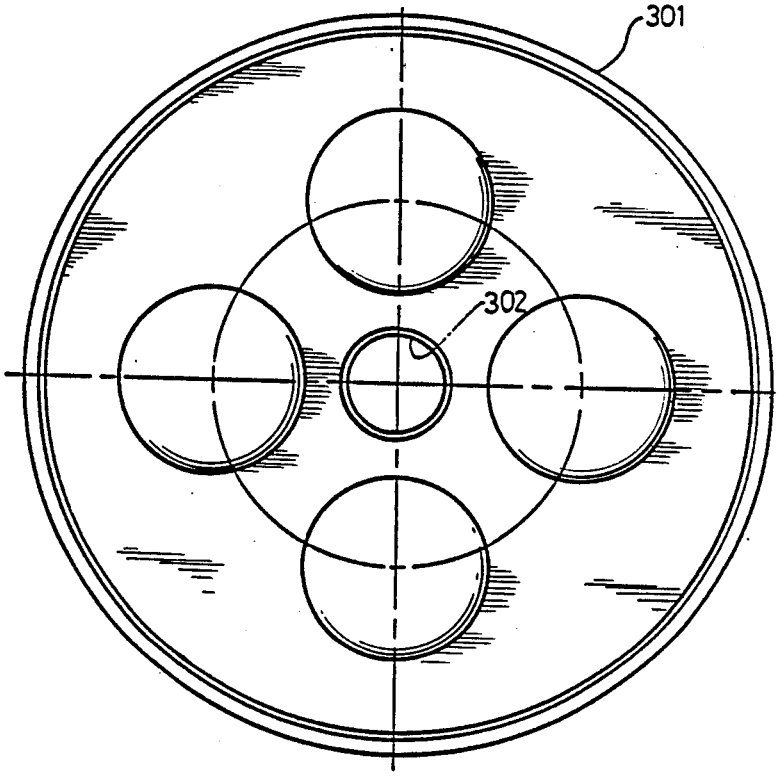
FIG. 17 is an elevated side view of an exemplary flywheel structure in accordance with the present invention.
Figures 1, 17:
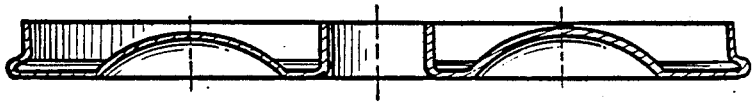
Figures 2, 17:
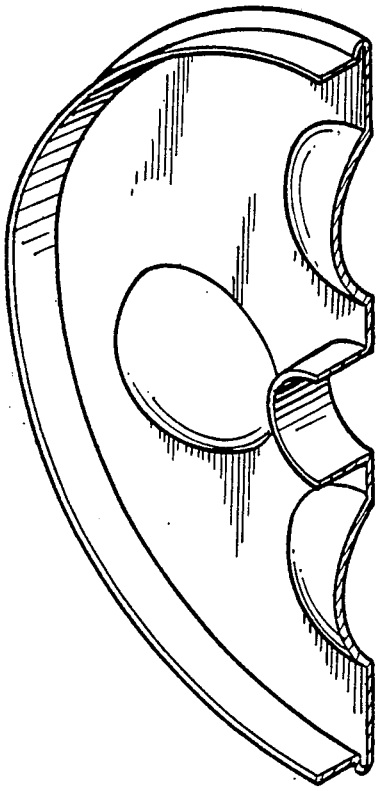
Figure 18:
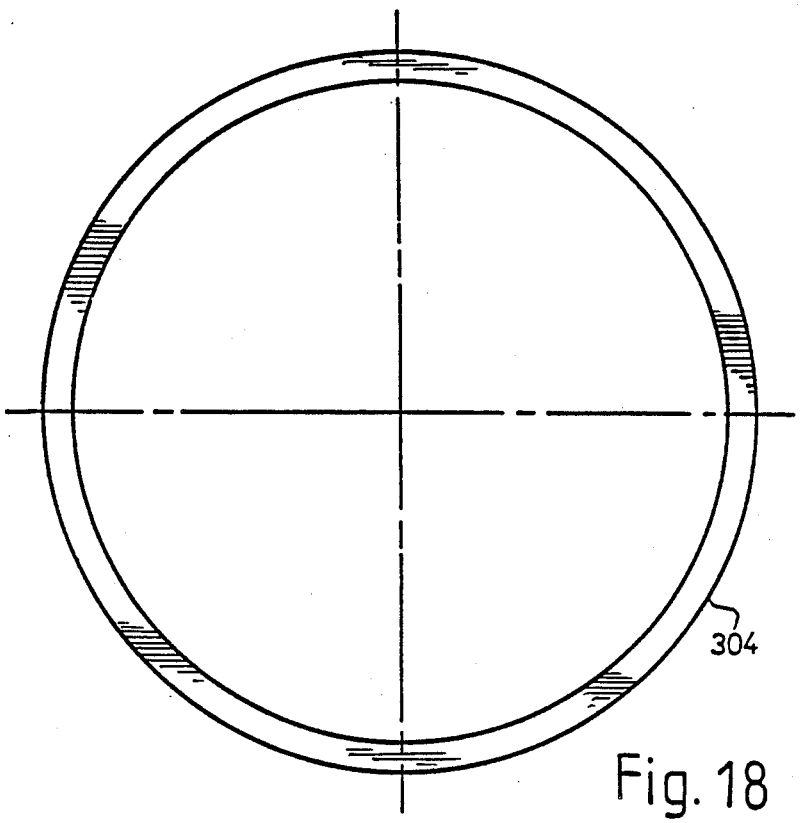
FIG. 18 is an elevated side view of a further exemplary flywheel in accordance with the present invention.
Figures 1, 18:
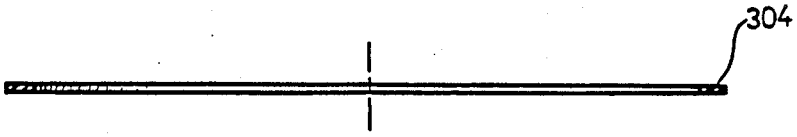
Figure 19:
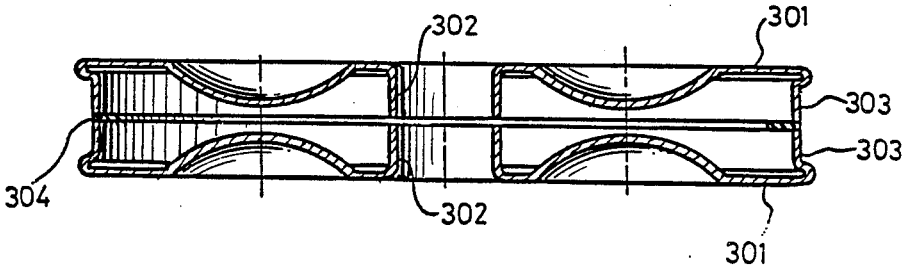
FIG. 19 is an elevated end view in cross-section of a further exemplary flywheel in accordance with the present invention.
Figures 1, 19:
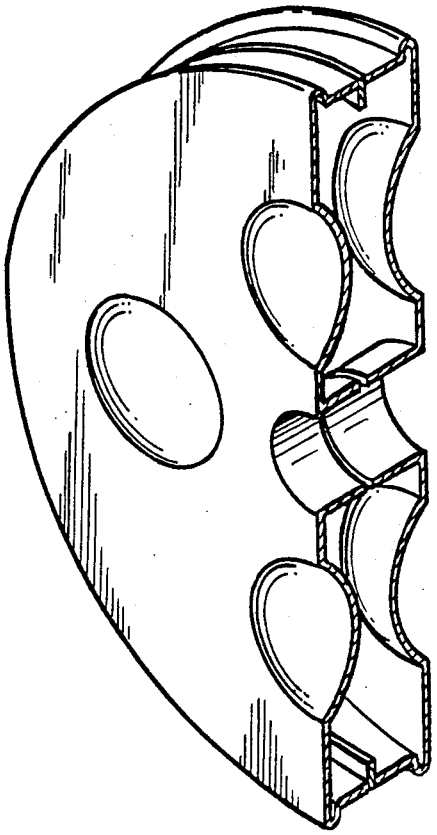

FIGS. 13 through 16-2 shows a further embodiment of the present invention which includes dual sets of pedal driving elements (one for rotation by the feet of a person seated in a first chair 12 and one for rotation by the feet of a person seated in a second chair 12'). The two sets of pedals apply the torque they generate to a common flywheel and/or motor/generator. In the embodiment shown in FIGS. 14 through 14-4, a swing-type adjuster plate 206 adjusts the degree of coupling between the two sets of pedals and the common driven shaft. FIGS. 15 through 15-2 show a further embodiment which includes a coaxial adjusting axle 210 and swingable branch handles 214 used for adjustment of chain coupling. FIGS. 16 through 16-2 show a further embodiment of a drive system for coupling the mechanical energy produced by dual sets of pedals to a common driven shaft. The embodiment shown in FIGS. 16 through 16-2 is a tri-axle double drive and driven structure.

In conclusion, the present invention provides a reclining and sitting exercise bicycle which permits two people to exercise simultaneously. An auxiliary seat is provided for an additional person to sit in and participate in the exercise activity to promote interest in exercising. A manual operational reaction training device permits the person(s) exercising to use hands and vision together. The person(s) exercising can pedal to exercise actively, or may select a mode of operation wherein the pedals are driven by a motor to rotate, and thereby exercise "passively."

I claim:

1. An exercising device comprising:

a main frame for resting on a surface;

a subsidiary frame member, mounted to and supported by said main frame at an angle inclined with respect to said surface, said subsidiary frame member defining a plurality of apertures arranged along a common line on a first surface thereof;

an elongated supporting shaft having first and second ends;

a mounting plate fixed to the first end of said supporting shaft;

U-shaped flange means fixed to the second end of said supporting shaft, said flange means including a flat portion and at least first and second legs extending from said flat portion in a direction axial to said supporting shaft, said first and second ends spaced apart a distance exceeding at least one dimension of said subsidiary frame member first surface, said flange means further including a pin projecting axially therefrom between said first and second legs, said pin having a length which is less than the lengths of either of said first and second legs, said pin having a diameter which is slightly less than the diameter of any of said plurality of apertures, said first and second legs defining first and second holes, respectively, in registry with one another, said flange means for reciprocally sliding along said subsidiary frame member and for engaging with a selected one of said plurality of apertures;

a locking means, extending through said hole in said first leg to said hole in said second leg, for pulling said first and second legs together and thereby retaining said elongated supporting shaft in a selected position whereat said pin extends into said selected one of said plurality of apertures;

a first seat fixed to said mounting plate; and a first set of pedals, rotatably journalled to one of said main frame and said subsidiary frame member, for being rotated by the feet of a person seated in said seat.

2. An exercise device as in claim 1 wherein said locking means includes:

a further pin extending through the holes defined through said first and second legs, said flange means and said further pin together completely surrounding at least one cross-section of said subsidiary frame member, one end of said further pin including an expanded portion for contacting said first leg; and lever means, fixed to another end of said further pin, for rotating between at least a locked position and an unlocked position, said lever means applying a force to said further pin which pulls said first and second legs toward one another when in said locked position, said lever means relieving said applied force when in said unlocked position.

3. An exercise device as in claim 1 further including auxiliary seat means, fixed to an end of said subsidiary frame member, for supporting an additional seated person.

4. An exercise device as in claim 3 further including:

a second set of pedals, rotatably journalled to said subsidiary frame, for being rotated by the feet of a person seated in said auxiliary seat;

means for damping rotational energy; and means for coupling said first and second set of pedals to said damping means.

* * * * *